US005317104A

United States Patent [19]

Frost

[11] Patent Number: 5,317,104

[45] Date of Patent: May 31, 1994

[54] MULTI-TIMBRAL PERCUSSION INSTRUMENT HAVING SPATIAL CONVOLUTION

[75] Inventor: David R. Frost, Santa Cruz, Calif.

[73] Assignee: E-muSystems, Inc., Scott Valley, Calif.

[21] Appl. No.: 996,884

[22] Filed: Dec. 28, 1992

Related U.S. Application Data

[63] Continuation of Ser. No. 641,842, Nov. 16, 1991, abandoned.

[51] Int. Cl.[5] ..... G10H 1/02

[52] U.S. Cl. ..... 84/625; 84/630; 84/660; 84/661; 84/DIG. 26

[58] Field of Search ..... 84/600-604, 84/622, 624, 625, 630, 659-661, DIG. 26

[56] References Cited

U.S. PATENT DOCUMENTS 4,706,291 11/1987 Kakubo et al. ..... 84/DIG. 26
4,727,581 2/1988 Bray ..... 84/DIG. 26
4,731,848 3/1988 Kendall et al. ..... 84/DIG. 26
4,984,495 1/1991 Fugimori ..... 84/603
5,025,472 6/1991 Shimizu et al. ..... 84/DIG. 26
5,027,687 7/1991 Iwamatsu ..... 84/600
5,029,509 7/1981 Serra et al. ..... 84/625

*Primary Examiner*—William M. Shoop, Jr.
*Assistant Examiner*—Brian Sircus
*Attorney, Agent, or Firm*—Heller, Ehrman, White & McAuliffe

[57] ABSTRACT

An electronic sound processor creates reverberation effects using a simulated impulse function. The simulated impulse response is generated by combining frequency bands of white noise. The power of each band decays exponentially in time. The time constants are generated from the characteristics of a real or imaginary listening space. A reverberated sound signal is generated from an original sound signal by convolution of the original signal and the simulated impulse response. The method can adapted to generated stereophonic signals and to generate a forward and inverse reverb effect using only one set of multiplications.

35 Claims, 10 Drawing Sheets

CONVOLUTION MATRIX

CONVOLUTION MATRIX TIME SHIFT

| SURFACE TREATMENT | ABSORPTIVITY AT FREQUENCY | | | | | |
|---|---|---|---|---|---|---|
| | 125 | 250 | 500 | 1000 | 2000 | 4000 |
| ACOUSTIC TILE, RIGIDLY MOUNTED | .2 | .4 | .7 | .8 | .6 | .4 |
| ACOUSTIC TILE, SUSPENDED IN FRAMES | .5 | .7 | .6 | .7 | .7 | .5 |
| ACOUSTICAL PLASTER | .1 | .2 | .5 | .6 | .7 | .7 |
| ORDINARY PLASTER, ON LATH | .2 | .15 | .1 | .05 | .04 | .05 |
| GYPSUM WALLBOARD, 1/2" ON STUDS | .3 | .1 | .05 | .04 | .07 | .1 |
| PLYWOOD SHEET, 1/4" ON STUDS | .6 | .3 | .1 | .1 | .1 | .1 |
| CONCRETE BLOCK, UNPAINTED | .4 | .4 | .3 | .3 | .4 | .3 |
| CONCRETE BLOCK, PAINTED | .1 | .05 | .06 | .07 | .1 | .1 |
| CONCRETE BLOCK, POURED | .01 | .01 | .02 | .02 | .02 | .03 |
| BRICK | .03 | .03 | .03 | .04 | .05 | .07 |
| VINYL TILE, ON CONCRETE | .02 | .03 | .03 | .03 | .03 | .02 |
| HEAVY CARPET, ON CONCRETE | .02 | .06 | .15 | .4 | .6 | .6 |
| HEAVY CARPET, ON FELT BACKING | .1 | .3 | .4 | .5 | .6 | .7 |
| PLATFORM FLOOR, WOODEN | .4 | .3 | .2 | .2 | .15 | .1 |
| ORDINARY WINDOW GLASS | .3 | .2 | .2 | .1 | .07 | .04 |
| HEAVY PLATE GLASS | .2 | .06 | .04 | .03 | .02 | .02 |
| DRAPERIES, MEDIUM VELOUR | .07 | .3 | .5 | .7 | .7 | .6 |
| UPHOLSTERED SEATING, UNOCCUPIED | .2 | .4 | .6 | .7 | .6 | .6 |
| UPHOLSTERED SEATING, OCCUPIED | .4 | .6 | .8 | .9 | .9 | .9 |
| WOOD/METAL SEATING, UNOCCUPIED | .02 | .03 | .03 | .06 | .06 | .05 |
| WOODEN PEWS, OCCUPIED | .4 | .4 | .7 | .7 | .8 | .7 |

FIG. 11

MULTI-TIMBRAL PERCUSSION INSTRUMENT HAVING SPATIAL CONVOLUTION

This is a continuation of application Ser. No. 07/641,842 filed Jan. 16, 1991 now abandoned.

CROSS REFERENCE TO RELATED APPLICATIONS

The present invention is related to co-pending applications entitled DIGITAL SAMPLING INSTRUMENT FOR DIGITAL AUDIO DATA, Ser. No. 462,392, filed Jan. 5, 1990 and DYNAMIC DIGITAL IIR AUDIO FILTER, Ser. No. 411,450 filed Sep. 25, 1989, and which are owned by the same assignee as the present invention.

BACKGROUND OF THE INVENTION

Field of the Invention

The present invention relates to an electronic musical instrument and more particularly to a multi-timbral percussion instrument having spatial convolution.

Multi-timbral percussion instruments can produce sounds based upon actual digital recordings of "real" instruments. Such type of sounds can be any type of percussion sound such as drum sounds and the like. It would be highly desirable to provide a multi-timbral percussion instrument which could directly implement artificial reverberation such as from real and/or imaginary structures without actually visiting or building those structure.

SUMMARY OF THE INVENTION

It is an object of the present invention to provide an improved multi-timbral percussion instrument. It is a more particular object to provide an improved multi-timbral percussion instrument having spatial convolution.

In one preferred embodiment, the present invention can directly implement artificial reverberation. A user can listen to and utilize reverberation from real and/or imaginary structures without visiting or building those structures.

Other objects, features and advantages of the present invention will become apparent from the following detailed description when taken in conjunction with the accompanying drawings.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 11 depicts a table illustrating approximate typical absorption coefficients.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
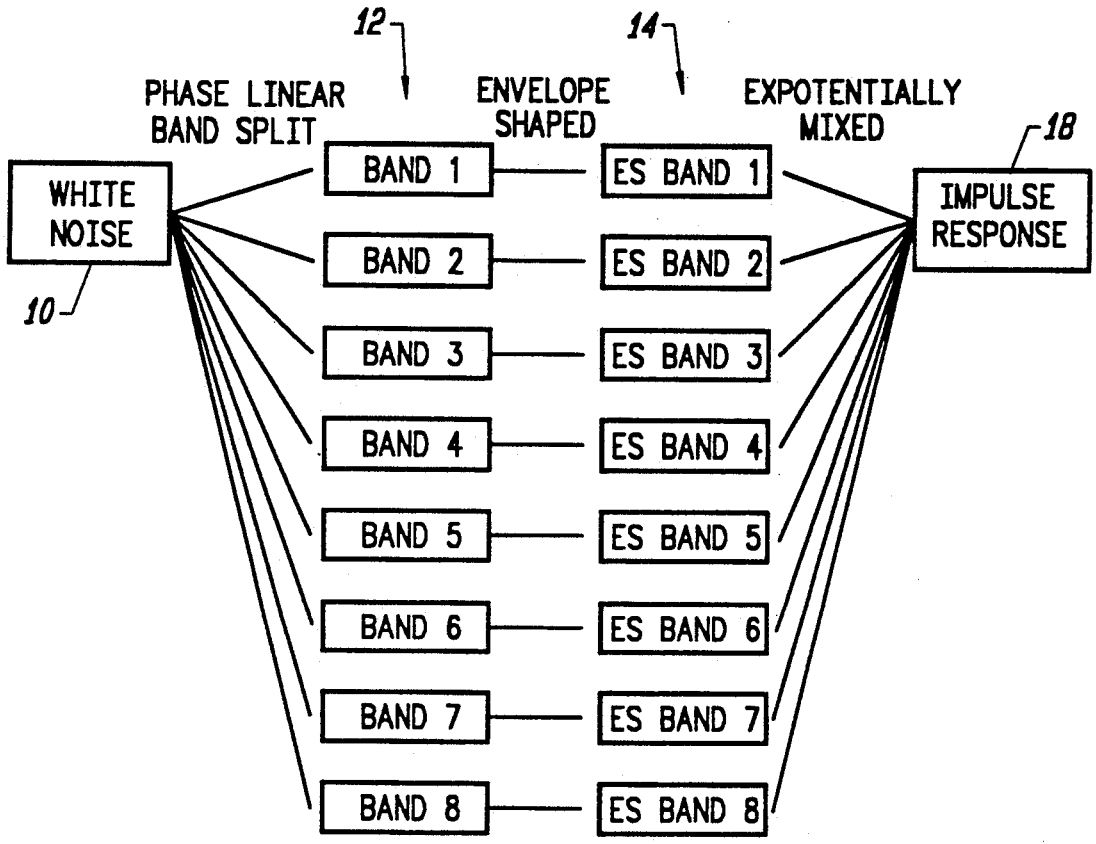
FIG. 1 depicts a diagram of the generation of an simulated impulse response according to the present invention.

FIG. 1 illustrates a white noise sample 10 which is band split with a phase linear filter 12 into 8 bands (the number of bands is arbitrary). Each band is a different frequency range which is shaped differently.

Figure 7:
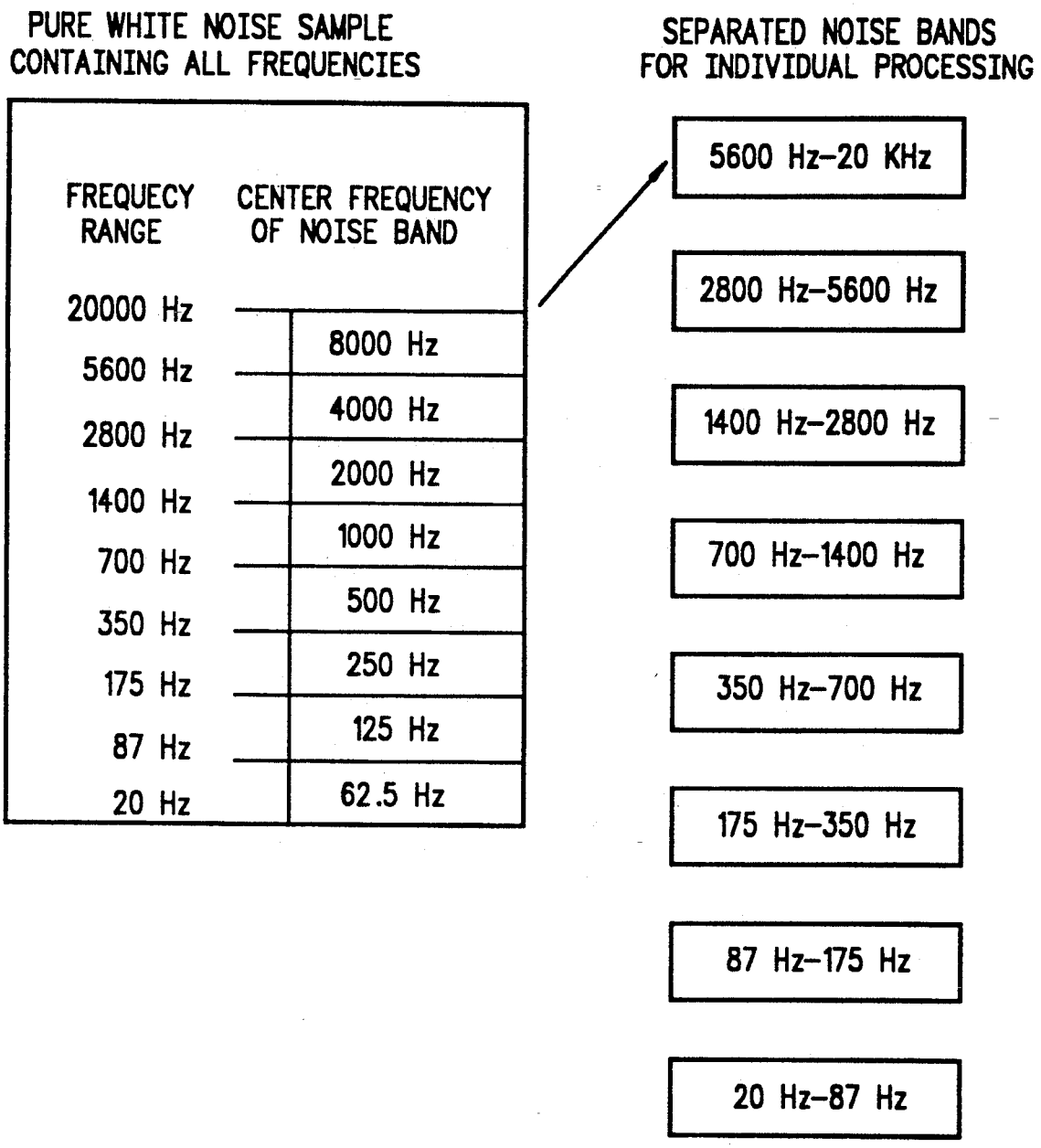
FIG. 7 depicts a diagram illustrating pure white noise sample containing all frequencies and separated noise bands for individual processing.

FIG. 7 depicts a specific example of the division of the spectrum from 20 Hz to 20 K Hz into eight frequency bands. The time dependent rms amplitude of each "frequency band." The frequency band is based on absorption coefficients. Typical absorption coefficient equivalents are found in many audio texts (see for example, FIG. 11). Once each of those bands is split according to criteria related to the desired reverb characteristics, the amplitude of each of those bands is shaped differently. For instance, each band may decay exponentially with a time constant determined by the absorption coefficients.

As each of the bands decays down, it is desired to achieve a constant rms amplitude tail about 60 db down from the initial peak value. It is not desired to decay down to silence because the constant rms amplitude tail will be utilized in a loop later on in the process. Each of those bands are shaped differently and decay down to a different level. Then they are all mixed back together and that gives the simulated impulse response 18.

Figure 2:
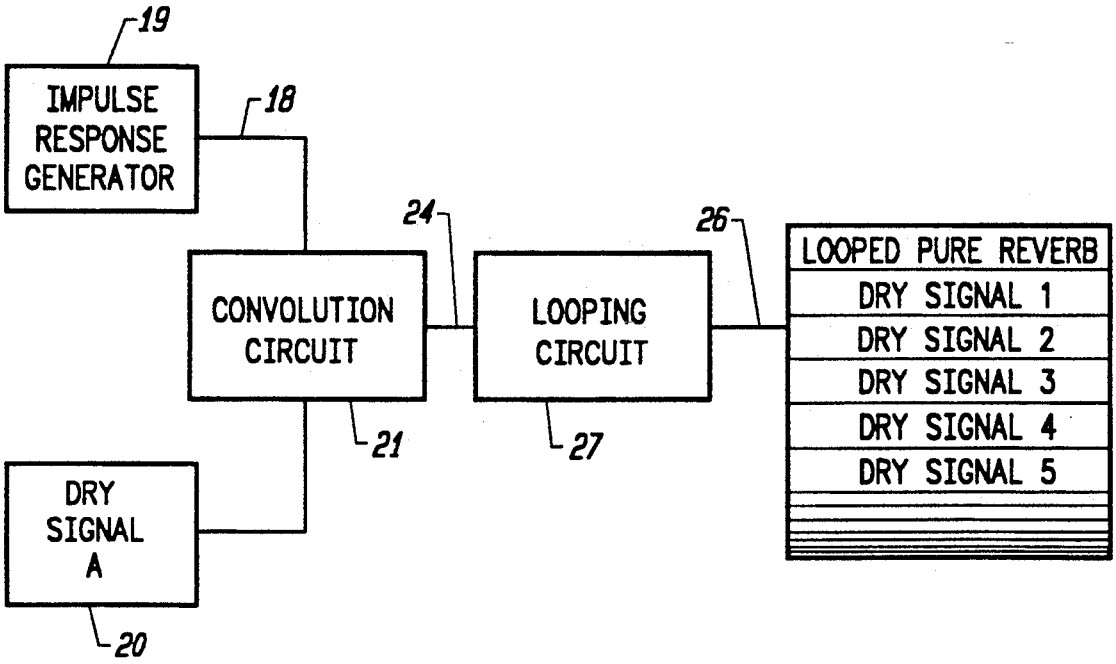
FIG. 2 depicts a diagram of the circuit which performs the convolution of impulse response with dry signal to form a pure reverb which is looped and placed in a sound memory with other sample data.
Figure 8:
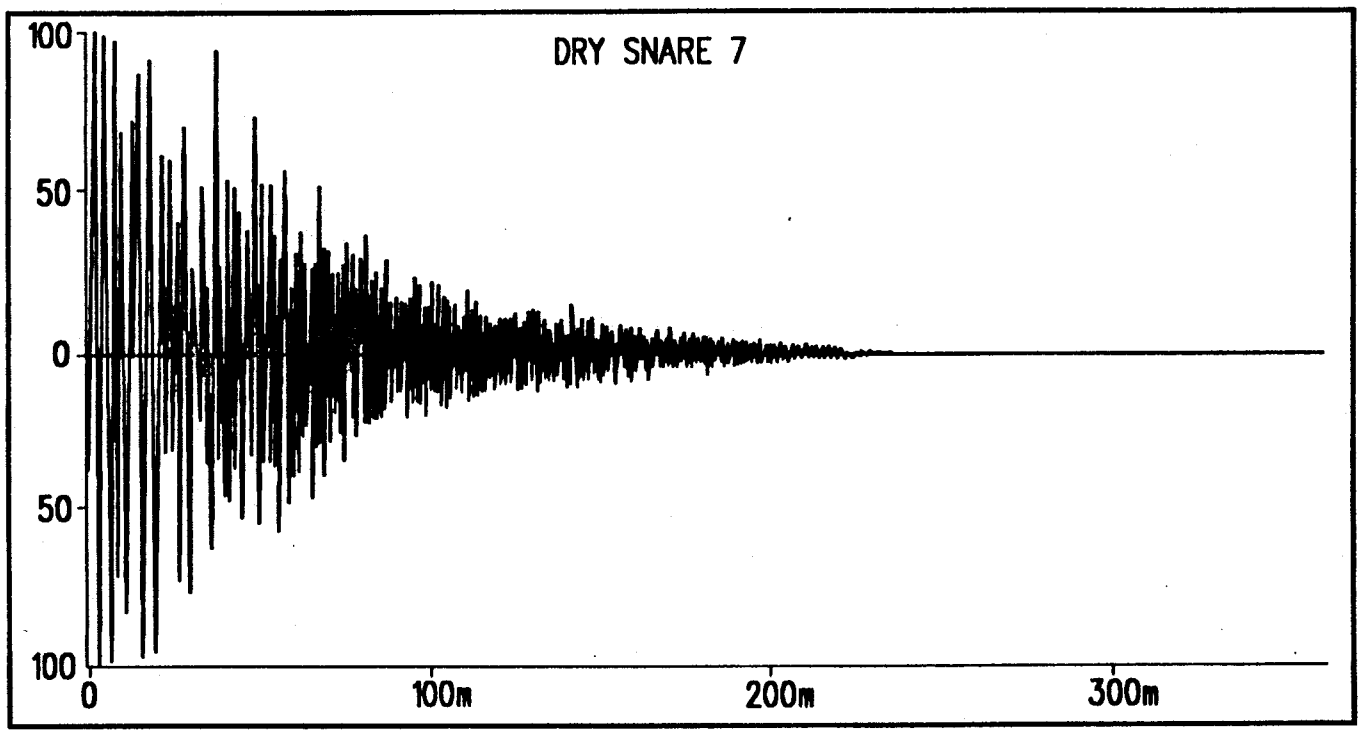
FIG. 8 depicts a diagram of a dry snare sound.

In FIG. 2, the impulse response 18 created in FIG. 1 by impulse generator 19 is convolved at a convolution circuit 21 with a dry (i.e. pre-reverb) signal A 20 to create pure reverb 24. Any dry signal such as the dry snare signal of FIG. 8, may be used.

Figure 9:
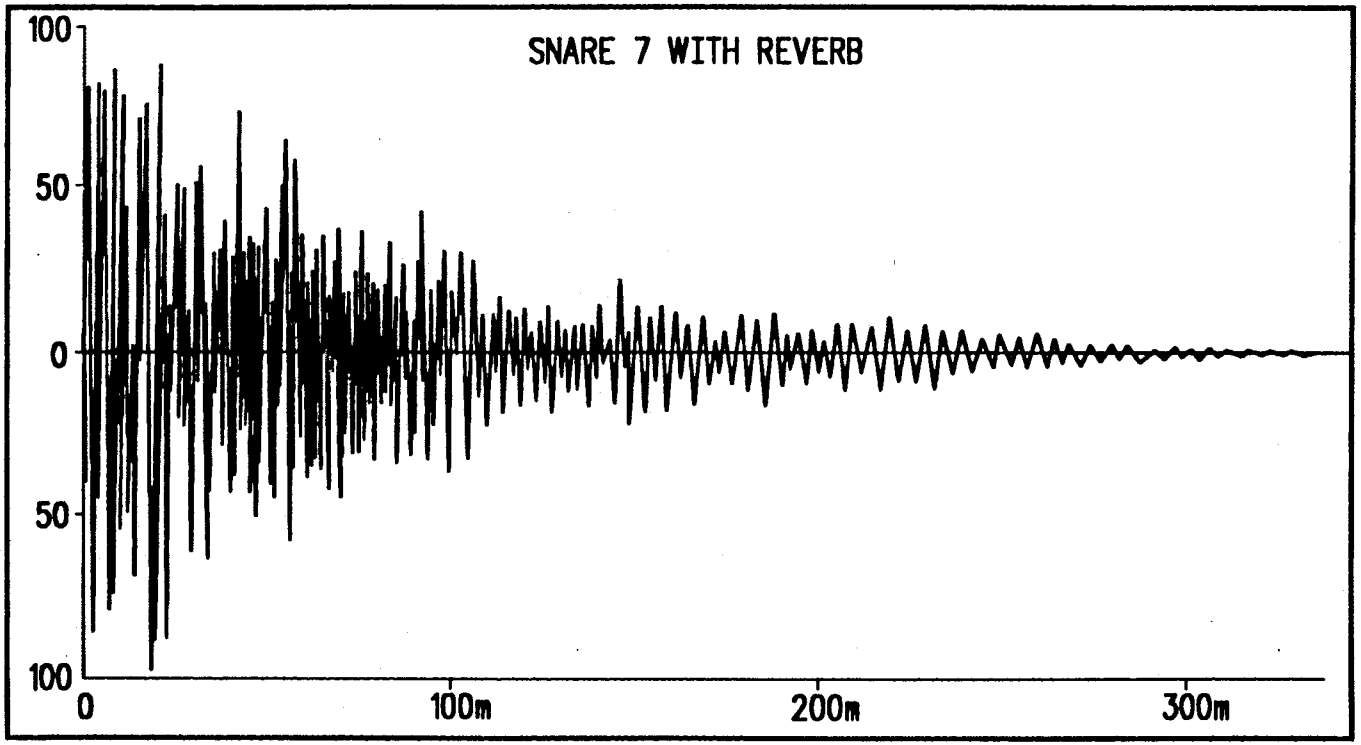
FIG. 9 depicts a diagram of a snare sound with reverb.
Figure 10:
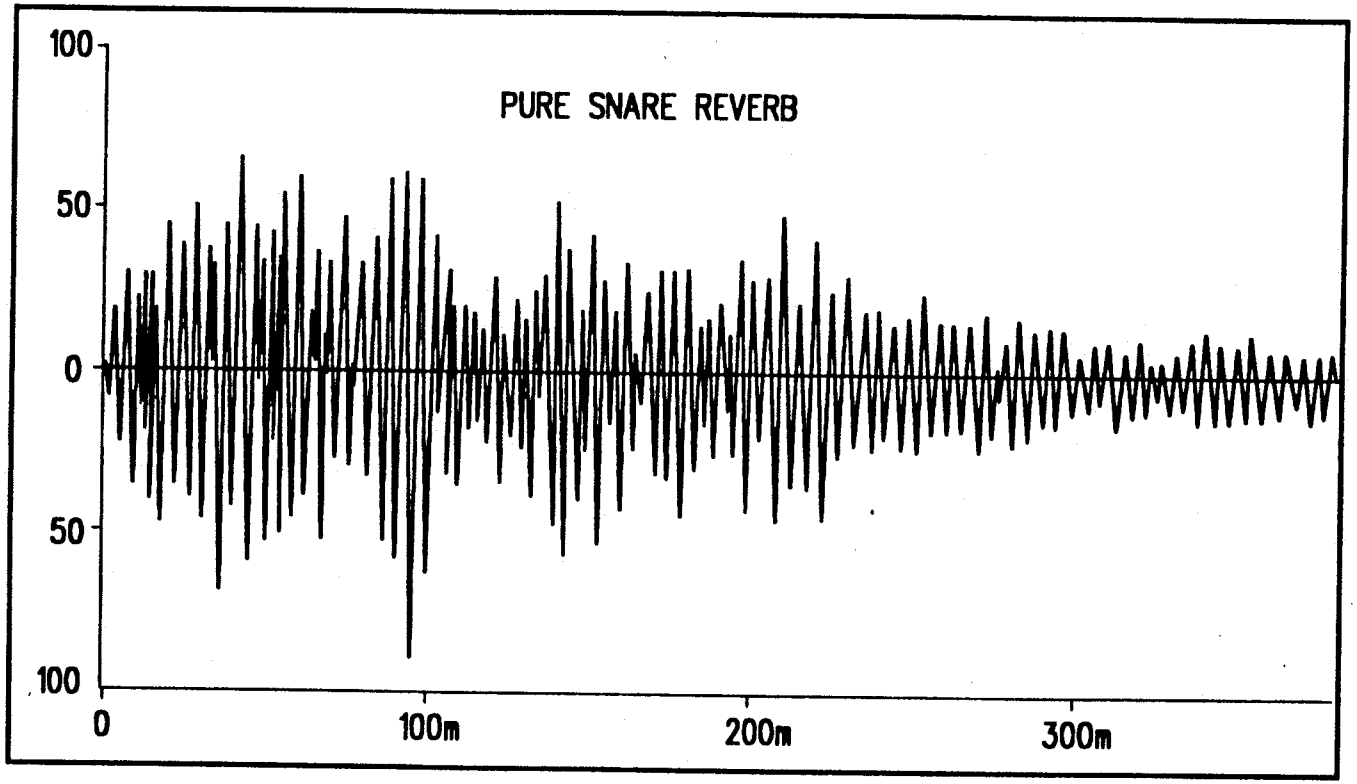
FIG. 10 depicts a diagram of a pure snare reverb sound.

One of the reverbs created could be a generic snare reverb representative of all snares. Convolving those two signals 18 and 20 yields the pure reverb 24 in FIG. 2. A snare with reverb signal is shown in FIG. 9 and the pure snare reverb is shown in FIG. 10. Once it's looped, it's placed in the sound memory 30 of FIG. 2.

Figure 6:
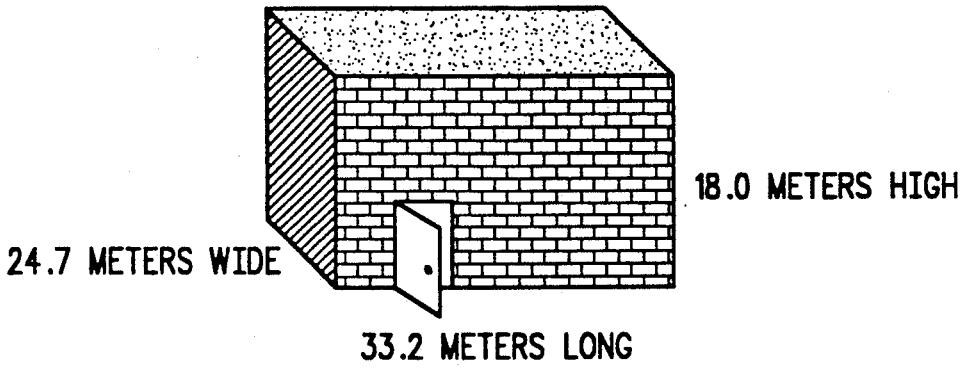
FIGS. 6 depicts an example of a rectangular room.

A program allows the direct modeling of actual rooms—either real or imaginary—so one can utilize reverb from those structures without actually visiting or building those structures (see FIG. 6).

In the design of real world physical structures (concert halls, churches, etc.) the following equation is used to implement the desired reverberation decay characteristics into the design (dimensions and materials) of the structure:

$$T_r = 0.16V/S_e$$

Where $T_r$ is the reverberation time in seconds, V the room volume in $m^3$ and $S_e$ the effective absorption area in $m^2$.

The invention's technique is to use this equation to directly implement artificial reverberation. Much like a seasoned architect, the user must apply expertise in identifying suitable dimensions and materials for the structure to produce the desired reverb characteristics. One usefulness of the invention is that the user can listen to and utilize reverb from real and/or imaginary structures without actually visiting or building those structures.

In FIG. 2, pure looped reverb 24 has been created. It should also be noted that the method of generating an impulse response described above is different than the standard technique in that an impulse signal is never present in the technique of the present invention.

In FIG. 2, the reverb and all the other signals are present in sound memory 30 In one embodiment, there are two reverb samples in a population of 200+ samples, so 1% of memory is devoted to reverb and 99% devoted to the dry signals. All the dry signals can then be reverberated based on the reverb present in the sound memory. The dry signals 1 through 7 can be any type of sound signal.

Figure 3:
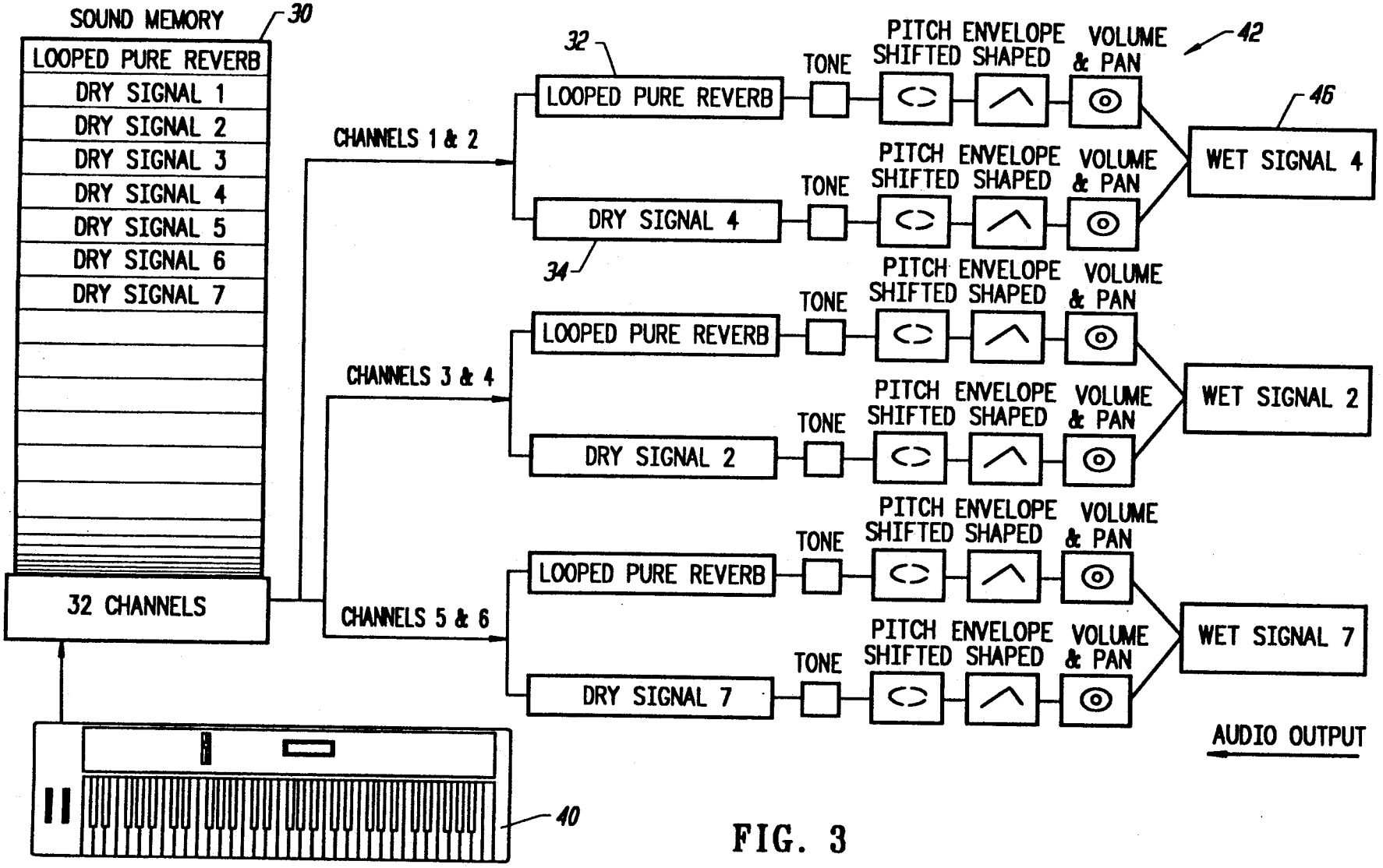
FIG. 3 illustrates a diagram of a multi-timbral percussion instrument utilizing spatial convolution according to the present invention.

In FIG. 3, the sound memory 30 is connected to suitable hardware and associated software and gives 32 audio channels available each moment in time. In FIG. 3, there are 6 channels in use and channels 1 and 2 are phase locked, 3 and 4 are phase locked, 5 and 6 are phase locked. Each individual channel has its own independent control of pitch shifting value, its own envelope shape, and its own volume and pan control. This allows control of the reverb for each sound individually.

In FIG. 3, a keyboard such as an EIII TM keyboard manufactured by Systems or any MIDI controller sends MIDI commands which trigger the signals and wheels and sliders can further modify those parameters in real time as the sounds and reverb are evolving. Wheels, sliders and specific key depressions can also control the apparent source location of sounds (pan values), pitch shifting, volume, the room size of other characteristics of the envelope of the signal. For example the parameter such as wet and dry mix are with the volume ratios placement in the ambient field and pan values. Each signal may have its own set of independent ambience parameters and associated controls.

Each of the channel pairs are phase locked after they've each gone through their own individual pitch shifting envelope and pan values—they're summed back together to yield the wet signal. A wet signal may be generally defined as an input signal which has been altered by some modifying process. In this case, 6 channels have been fired and 3 independent wet signals are summed and can be routed to any of the audio outputs.

Exceptionally smooth and beautiful reverbs can be created with convolution. Rooms highly regarded for their reverb qualities have impulse responses that take the form of exponentially decaying white noise. When this type of impulse response is convolved with another sound, say for example a pitched percussion sample, then this percussion sample will be transformed. The percussion sample will sound like it is emanating from the room from which the impulse response was derived.

A product can utilize reverb produced via convolution without adding to the hardware cost of the instrument. Many different types of reverb rooms/effects can operate simultaneously in real time. This is desirable; separate reverbs for the different tracks of your mix often sounds much better than one reverb for your whole mix. Multiple reverbs certainly sound better than no reverb at all.

How Spatial Convolution Works

The present invention adds reverb ambience to a sound by combining a "convolved" reverb sound with a "dry" drum sound of the same type. Convolution involves combining two sounds so that only frequency components common to both sounds are accentuated while uncommon frequencies are discarded. The reverb tail can be turned and shaped like an ordinary sample. Reverb is intended to cover both ambience and resonance.

A pure reverb sample that has an amplitude envelope shape with a relatively constant sustain level can be easily looped at this fixed sustain level. The reverb sample is transposed by pitch shifting both the attack portion and the looped portion, and the envelope shape of the looped portion of the reverb is shaped by a VCA to have a decay time which corresponds to the room size, thereby providing a reverb which can be transposed across the keyboard with a fixed reverb decay time. Phase locking this pure reverb with the dry version of the sample, from which the reverb was derived, creates a very flexible high quality reverberated signal.

By providing a separate VCA envelope and pan control for the pure wet and pure dry signal, an unusually high degree of realtime control is obtained over the reverb. Possible effects include reverse reverb, gated reverb, large room, small room, Lfo modulated reverb, fixed detuning, control of width imaging, pitch envelope reverb effect, etc. With a single pure reverb sample, all of these different reverbs can exist simultaneously on adjacent keys, non-transposed or transposed to any desired pitch.

Pure reverb (no dry signal) of any desired amplitude envelope contour can be created with just a handful of commercially available digital signal processing products. To "artificially" create pure reverb:

1) Prepare a pure white noise sample.

2) Band split the noise into octave bands.

3) Look-up absorption coefficients of materials in simulated room and generate the time constants for the decay of each band. Shape each band using controls such as taper and gain. Since high frequencies tend to have a faster "roll-off" it is to be expected that the envelopes for the high frequency bands will decay faster and possibly stabilize at a lower level.

4) Recombine the bands back into a composite sample (use the EIII exponential digital mix function). This is the reverb impulse response.

5) Convolve the reverb impulse response with a dry sample. The noise like reverb impulse response turns into a pure reverb version of the dry sample.

Spatial convolution by convolution circuit 21 provides high quality reverb, multiple simultaneous effects, high degree of programmability and realtime control, and a sound can "borrow" other sound's reverb to create new sound.

Spatial Convolution Equations Where:

d (n1)=dry signal of length n samples, and e (n2)=reverb impulse (effect) of length n samples, let:

z (n3)=convolution of d (n1) and e (n2).

The convolution [z (n3)] of the dry signal with the reverb impulse response can then be represented with either of the following equations:

$$z(n3) = d(n1) * e(n2), \text{ where } n3 \text{ is of length } (n1 + n2) - 1$$

or $$z(n) = \sum_{m=0}^{n} d(m)e(n - m)$$

Example:

For $d(n) = (1, 12, 64, 1)$ and $e(n) = (2, 36, -28, 14)$ $d(n) * e(n) =$

| | | | | | | | |
|---|---|---|---|---|---|---|---|
| | 2 | 24 | 128 | 2 | | | |
| + | | 36 | 432 | 2304 | 36 | | |
| + | | | −28 | −84 | −1792 | −28 | |
| + | | | | 14 | 168 | 896 | 14 |
| $z(n) =$ | (2, | 60, | 532, | 2244, | −1588, | 868, | 14) |

This example uses the "long convolution" process to achieve the convolved output. Every sample of waveform "d" is multiplied by every sample of waveform "e". The resulting waveform "z" is the convolved output. This is the traditional method of utilizing convolution.

Another method termed "fast convolution" is implemented by calculating the FFTs (Fast Fourier Transform) of elements "d" and "e". The FFTs of these waveforms are then multiplied to yield the FFT of the convolved output. This "convolved FFT" is then translated back into the time domain to yield the convolved sample data waveform "z". The advantage of fast convolution is in the reduction of multiplies necessary to yield the convolved output. Problems inherent to fast convolution include: overlap overlay scheme artifacts (clicking, pops, disjointed qualities), and inherent noise and signal degradation qualities introduced by the FFT (longer files increase degradation).

Both techniques are valuable. Fast convolution is a powerful auditioning tool and is often all that is required for many tasks. Long convolution is appropriate when dealing with large file sizes and/or when highest quality output is desired. The trade off is that long convolution requires significantly greater multiplies (computing time and power) than fast convolution.

Figure 4:
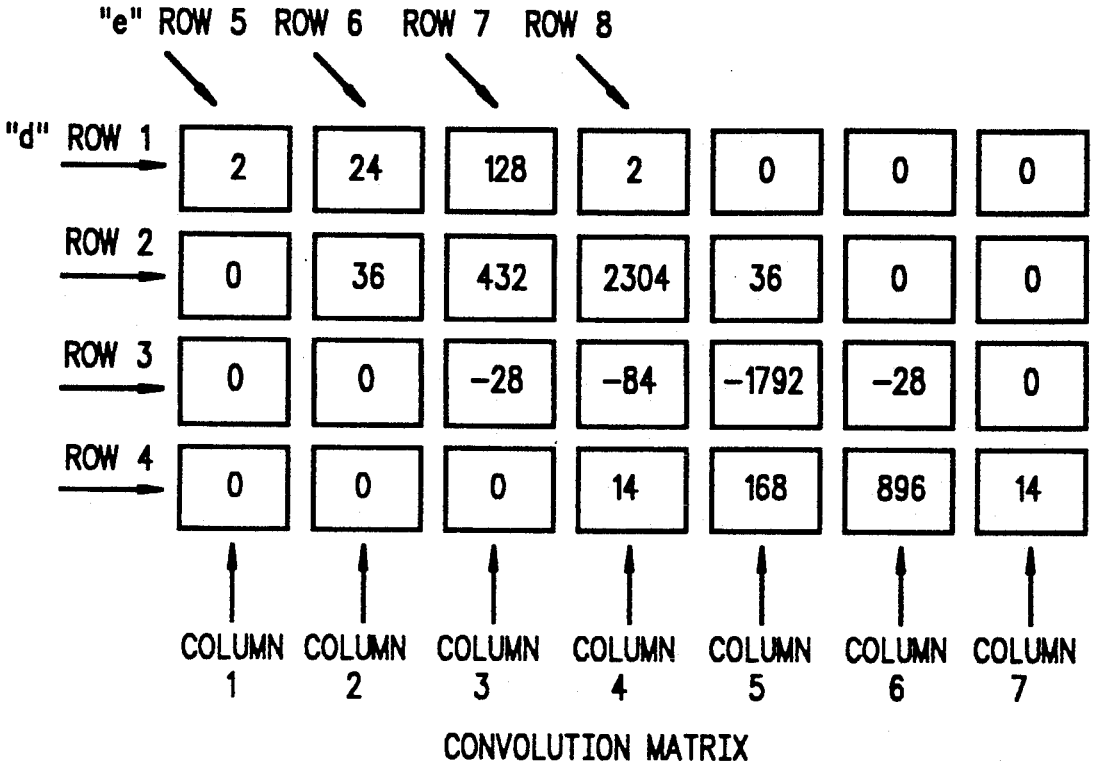
FIG. 4 depicts a diagram of convolution matrix.

When utilizing the long convolution process, the invention's technique is to add zeros as place holders in the time domain for each waveform row. This is exemplified in FIG. 4 where a "Convolution Matrix" is established for example 1. For all "d" rows, no shift of waveforms in the time domain is apparent other than from the zero placeholders. For all "e" rows, the first column that a value for that row appears in is the time domain placeholder.

These zero placeholders can be manipulated to great advantage. The final resultant convolution waveform is considered in theory to be a commutative identity, but all products of convolution are not necessarily commutative. Extractions from the Convolution Matrix necessitate attention to these non commutative properties.

Figure 5:
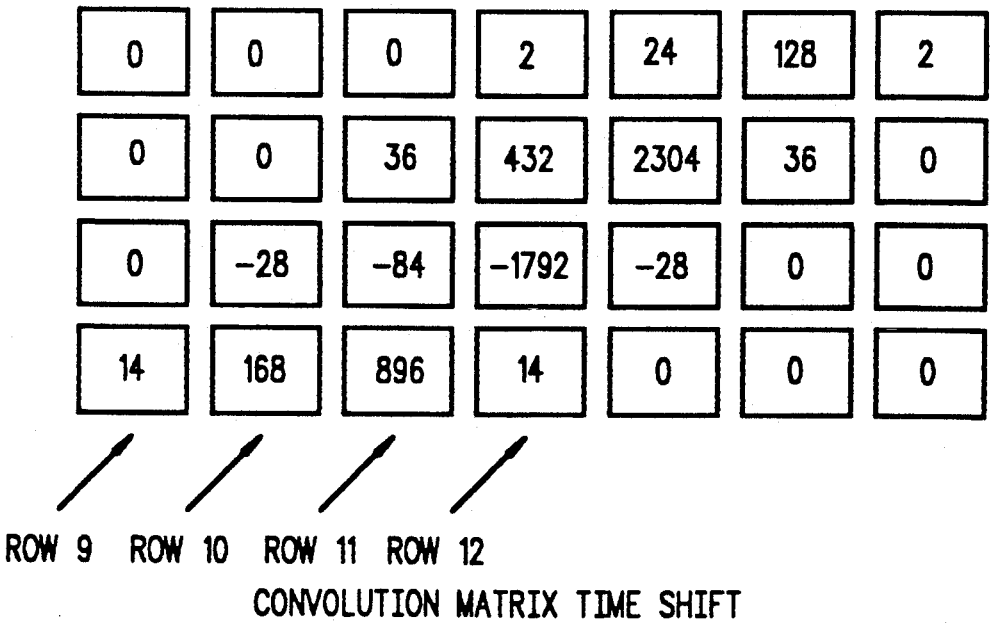
FIG. 5 depicts a diagram of convolution matrix time shift.

In FIG. 5 a "Convolution Matrix Time Shift" is represented. For rows (1–4 "d") zero placeholder values have been exchanged with the opposite end of the waveform. When columns 1–7 have been summed, the resultant waveform is equivalent to having reversed one of the two initial waveforms before convolving them. The invention's technique of computing Inverse Reverb & Forward Reverb with a single set of multiplies (one Convolution Matrix) is very powerful. Inverse Reverb is quite different than simply playing the Forward Reverb backwards. Traditionally, two sets of multiplies would be required to produce these two different reverb types.

The Convolution Matrix also allows stereo reverb pairs (separate left and right signal) to be extracted from a single monophonic impulse response using only one set of multiplies. For example, using the Convolution Matrix, only even numbered "d" rows are summed for each column to yield the left signal, only odd numbered "d" rows are summed for each column to yield the right signal. Extractions from the "e" rows can be similarly utilized. Given the even/odd extraction scheme, the "e" row's left/right stereo pair will sound different than that from the "d" row when played in stereo, but when summed mono the stereo pair from the "e" row will sound the same as the pair from the "d" row. Independent of which row type is utilized, other schemes exist for determining which specific rows are summed to either the left or right side of the stereo image.

As long as phase coherency and relative amplitude level between the left and right signals is maintained, when these signals are summed mono (as is done for AM radio or Television) the output will be equivalent to the basic convolution output (figure waveform "z"). This technique of extracting a stereo signal from waveforms "d" and "e" may actually help the ear to appreciate the complex interaction of dynamically smearing these spectra (convolving). The technique employed can be further extended to create quadraphonic reverb (rotation of every forth row to a quadrant, or stereo pairs from both the "d" and "e" rows are used to fill the quadrants).

Additionally, combining only some elements of both row types, say odd "e" rows with even "d" rows, can create unusual results (which may or may not be desirable).

The zero placeholder values can be manipulated to create spectral time expansion/compression effects. For expansion: every three rows, add an additional 0 to that row and every row thereafter. Or multiply all 0 placeholder values by expansion value greater than one, e.g. 1.765, and round off. For compression: multiply all zero placeholder values by a compression value less than one, e.g. 0.723, or subtract a 0 every n rows and every row thereafter.

Expansion/compression values can be manipulated with logarithmic scaling as the waveform evolves over time. It is also possible to expand the attack portion and then compress the body and sustain by utilizing a dynamically changing expansion/compression value. It is further possible to both compress and expand the spectra at all moments in time. Zeros are added both to the front and rear of the waveform as determined by a modulating pulse wave with a variable duty cycle.

The reverb characteristics of a room are much like the resonant qualities of a guitar or piano body. Sound continues to emanate from all these structures even after the exciting force (string, reed, voice, etc) has ceased its propagation of sound (stopped vibrating). An obvious extension of the Spatial Convolution techniques is in the implementation of piano and other types of resonance. With the use of wheels, damper pedals, etc. the end user may make determinations as to the resonant qualities they wish to be present for the sample playback instrument at any moment in time (even in the middle of a performance). The techniques of Spatial Convolution can be extended to add various resonant ambience qualities to any type of sounds (realtime grafting). For example a piano can easily "borrow" the resonant qualities of a guitar in the first half of a song, then use its own piano resonance in the second half of the song while the guitar switches between using piano and guitar resonance every four measures. Most importantly, these changes can be made or not made, at the performers whim, while in the midst of a performance.

Through the convolution process each waveform sample is effectively multiplied by every sample of the other waveform.

Many different independent "waveforms" (x/y axis sample data plots) exist in the convolution matrix. Each waveform can be viewed as of equal length with successive shifts in the time domain.

Numerical sets "d" and "e" can be each be independently represented over time as sample data on an x/y axis with x as the time, and y as the specific audio amplitude at each point in time. Once these two spectra are multiplied the resulting convolution output can then similarly be represented on the x/y axis.

Stereo reverb may be exacted from a reverb impulse response in either of the following two sources:

1) Stereo impulse response- (impulse with left and right sample).

2) Monophonic impulse response- (singular impulse response).

add even and odd rows only, or two detuned audio channels for single reverb "voice".

The Present Invention Provides

Isolating and storing the wet and dry versions of a signal as separate samples (for later combined playback).

Looping the reverb.

Creating new sounds that use another sounds reverb.

Creating reverb (impulse responses) based on hypothetical (imaginary and/or hybrid) structures and materials.

Reverb (impulses) based on hypothetical dynamically changing structures (a wooden rectangular cube room that changes into a stone pyramid room over the course of several seconds).

Pitch shifting these signals in real time.

Envelope shaping these resultant signals in real time.

Realtime control of relative amplitude levels.

Realtime modification of attack and release times new.

Realtime control of onset of predelay or early reflections.

Pitch shifted playback of all reverb signals when they are paired with a dry signal (the pitch shifted reverb sample is used to create the ambience) is desirable. The storing of reverb as sample data for pitch shifted playback adds an ambience effect to the playback of other sample data.

The pitch shifted playback of a convolved signal audio channel with its original audio signal(s) is desirable. This provides for applications such as pure soundboard piano resonance, sympathetic vibration, etc.

The end user can create looped reverb samples produced via convolution (the loop is a very important component of utilizing the realtime envelope shaping-/pitch shifting technique).

A suitable type of hardware and associated software which could be utilized with the invention of FIG. 3 is described for example in more detail in the cross referenced applications identified above. A suitable type of keyboard instrument is one known as the EIII which is manufactured by E-mu Systems, Inc., (the same applicant for the present invention).

The foregoing descriptions of specific embodiments of the present invention have been presented for purposes of illustration and description. They are not intended to be exhaustive or to limit the invention to the precise forms disclosed, and it should be clear that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A multi-timbral instrument comprising means for creating a reverb impulse response, said means for creating a reverb impulse response comprising a noise signal generator for generating a noise signal, filter means for band-splitting the noise signal produced by said noise signal generator into a plurality of frequency bands each having a power amplitude, means for tapering the power amplitude of each of said bands to form tapered bands, said tapered bands having an initial decay section and a subsequent substantially constant power amplitude section, and means for combining said tapered bands to form said reverb impulse response, and means for spatially convolving said reverb impulse response with a dry sound to create a pure reverb version of aid dry sound.

2. An instrument as in claim 1 including means for looping said substantially constant power amplitude section of said tapered bands.

3. An instrument as in claim 2 including means for looping said pure reverb to create a looped pure reverb, and means for storing said looped pure reverb.

4. The instrument as in claim 1 wherein said dry sound is not present in said impulse response.

5. The instrument as in claim 3 including means for storing said dry sound and said pure reverb version of said dry sound.

6. The instrument as in claim 3 wherein one portion of said storing means is devoted to reverb and a second, larger portion of said storing means is devoted to dry sound.

7. The instrument as in claim 6 wherein said first portion constitutes approximately 1-5% of said storing means and said second portion constitutes approximately 95-99% of said storing means.

8. The instrument as in claim 6, wherein any dry sound can be reverberated based on the reverb present in said storing means.

9. The instrument as in claim 3 including means for controlling a mix of dry signal and looped reverb.

10. The instrument as in claim 9 wherein said controlling means determines pitch shift, envelope shape, volume, and pan values.

11. The instrument as in claim 1 wherein said means for convolving includes means for computing inverse reverb and forward reverb with a single set of multiplies.

12. The instrument as in claim 11 wherein said set of multiples consists of one convolution matrix.

13. The instrument as in claim 1 wherein said reverb impulse response is generated from a different sound than said dry sound with which said reverb impulse response is convolved.

14. The instrument as in claim 1 wherein said reverb impulse response is based on hypothetical structures or materials.

15. The instrument as in claim 14 wherein said reverb impulse response is based on dynamically changing structures or materials.

16. The instrument as in claim 10 wherein said pitch shifting is in real time.

17. The instrument as in claim 10 wherein said envelope shaping is in real time.

18. The instrument as in claim 9 wherein control of relative amplitude levels is in real time.

19. The instrument as in claim 9 wherein modification of attack and release time is in real time.

20. The instrument as in claim 9 wherein control of onset of predelay or early reflections is in real time.

21. In multi-timbral instrument, a method which comprises the steps of:

creating a reverb impulse response, said creating step including the steps of generating a noise signal, band-splitting said noise signal into a plurality of frequency bands each of said bands having a power amplitude, tapering the power amplitude of each of said bands to provide tapered bands, each of said tapered bands having an initial decay section and a subsequent substantially constant power amplitude section, and combining said tapered bands to form said reverb impulse response, and spatially convolving said reverb impulse response with a dry sound to create a pure reverb version of said dry sound.

22. A method as in claim 21, which further comprises the steps of:

looping said pure reverb, creating a looped pure reverb, storing said looped pure reverb, said dry sound and said pure reverb, and reverberating a new dry sound based on said stored reverb.

23. A method as in claim 22, which further comprises the step of:

controlling a mix of said new dry sound and said looped reverb.

24. An instrument as in claim 1 wherein said means for tapering produces an exponential decay of said initial decay section of each said band.

25. An instrument as in claim 24 wherein said pure reverb version simulates the reverberation in a room and the time constants for said exponential decays are determined by the absorption coefficients of materials in said room.

26. An instrument as in claim 25 wherein said time constants are approximately proportional to the volume of said room and inversely proportional to said absorption coefficients.

27. A method as in claim 21 wherein said tapering step produces an exponential decay of said initial decay section of each said band.

28. An instrument as in claim 27 wherein said pure reverb version simulates the reverberation in a room and the time constants for said exponential decays are determined by the absorption coefficients of materials in said room.

29. An instrument as in claim 28 wherein said time constants are approximately proportional to the volume of said room and inversely proportional to said absorption coefficients.

30. An instrument as in claim 1 wherein said pure reverb version simulates the reverberation in a room, said pure reverb version having an attack portion and a looped post-attack portion, said instrument further comprising a means for pitch shifting said pure reverb signal while maintaining the ambience characteristics of said room including a means for altering the playback rate of said pure reverb signal and a means for envelope shaping said looped portion.

31. A multi-timbral instrument comprising means for creating a reverb impulse response, said means for creating said reverb impulse response comprising a noise signal generator for generating a noise signal, filter means for band-splitting the noise signal produced by said noise signal generator into a plurality of frequency bands each having a power amplitude, means for tapering the power amplitude of each of said bands to form tapered bands, and means for combining said tapered bands to form said reverb impulse response;

means for spatially convolving said reverb impulse response with a first dry sound having a first pitch to create a pure reverb version of said dry sound, said pure reverb version of said dry sound having a playback rate such that a sound pitch of said pure reverb version of said dry sound is equal to said first pitch;

means for altering said playback rate of said pure reverb version of said dry sound by a given factor to produce a pitch shifted pure reverb version of said dry sound having an envelope shape; and means for altering said envelope shape of said pitch shifted pure reverb version of said dry sound to produce a transposed pitch shifted pure reverb version of said dry sound.

32. The instrument of claim 31 wherein said envelope shape is comprised of an initial decay portion and a subsequent constant power section, and said means for altering said envelope shape is comprised of a means for altering said subsequent constant power section.

33. The instrument of claim 32 further including means for combining said transposed pitch shifted pure reverb version of said dry sound with a second dry sound to produce a wet sound, said second dry sound having a third pitch.

34. The instrument of claim 33 wherein said given factor is approximately equal to the ratio of said third pitch to said first pitch.

35. The instrument of claim 34 wherein said means for altering said subsequent constant power section imposes an exponentially decaying envelope.

* * * * *